US007273040B2

(12) United States Patent
Shouda et al.

(10) Patent No.: US 7,273,040 B2
(45) Date of Patent: Sep. 25, 2007

(54) AIR-FUEL RATIO CONTROL APPARATUS FOR INTERNAL COMBUSTION ENGINE

(75) Inventors: Tomohisa Shouda, Tokyo (JP); Keiichi Enoki, Tokyo (JP); Hideaki Tani, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/326,334

(22) Filed: Jan. 6, 2006

(65) Prior Publication Data

US 2007/0023021 A1 Feb. 1, 2007

(30) Foreign Application Priority Data

Jul. 29, 2005 (JP) ..... P2005-220326

(51) Int. Cl.
*F02D 41/06* (2006.01)

(52) U.S. Cl. ..... 123/491; 123/685

(58) Field of Classification Search ..... 123/685, 123/435–436, 491
See application file for complete search history.

(56) References Cited

U.S. PATENT DOCUMENTS 4,886,035 A * 12/1989 Tomobe et al. ..... 123/588
5,519,992 A * 5/1996 Hosoya et al. ..... 60/276
6,223,730 B1 * 5/2001 Hasegawa et al. ..... 123/491
6,257,207 B1 * 7/2001 Inui et al. ..... 123/491
6,477,833 B2 * 11/2002 Tayama et al. ..... 60/285
6,477,834 B1 * 11/2002 Asanuma et al. ..... 60/295
6,736,114 B2 * 5/2004 Takahashi et al. ..... 123/491
7,047,727 B2 * 5/2006 Tanaka et al. ..... 60/284

FOREIGN PATENT DOCUMENTS

JP 166924 * 6/1995
JP 8-312428 A 11/1996
JP 2001-32739 * 2/2001
JP 2001-214778 * 8/2001

* cited by examiner

*Primary Examiner*—Hai Huynh
(74) *Attorney, Agent, or Firm*—Sughrue Mion pllc.

(57) ABSTRACT

At the time of start-up, fuel supply is made excessive. When air-fuel ratio feedback control is started while the fuel is excessive, the control is put into a state of overshoot or hunting, and it takes a long time to converge to the target air-fuel ratio. In an air-fuel ratio control apparatus, a selection switch is provided at the output of an integration calculation circuit to perform air-fuel ratio feedback control, and immediately after start-up of the engine, an upper/lower limit clip value for use immediately after start-up, which is smaller than a normal one, is selected to perform the air-fuel ratio feedback control. Even if the air-fuel ratio feedback control is started immediately after the start-up in a state where the fuel is excessive, the actual air-fuel ratio does not overshoot with respect to the target air-fuel ratio and is quickly converged to the target air-fuel ratio.

16 Claims, 9 Drawing Sheets

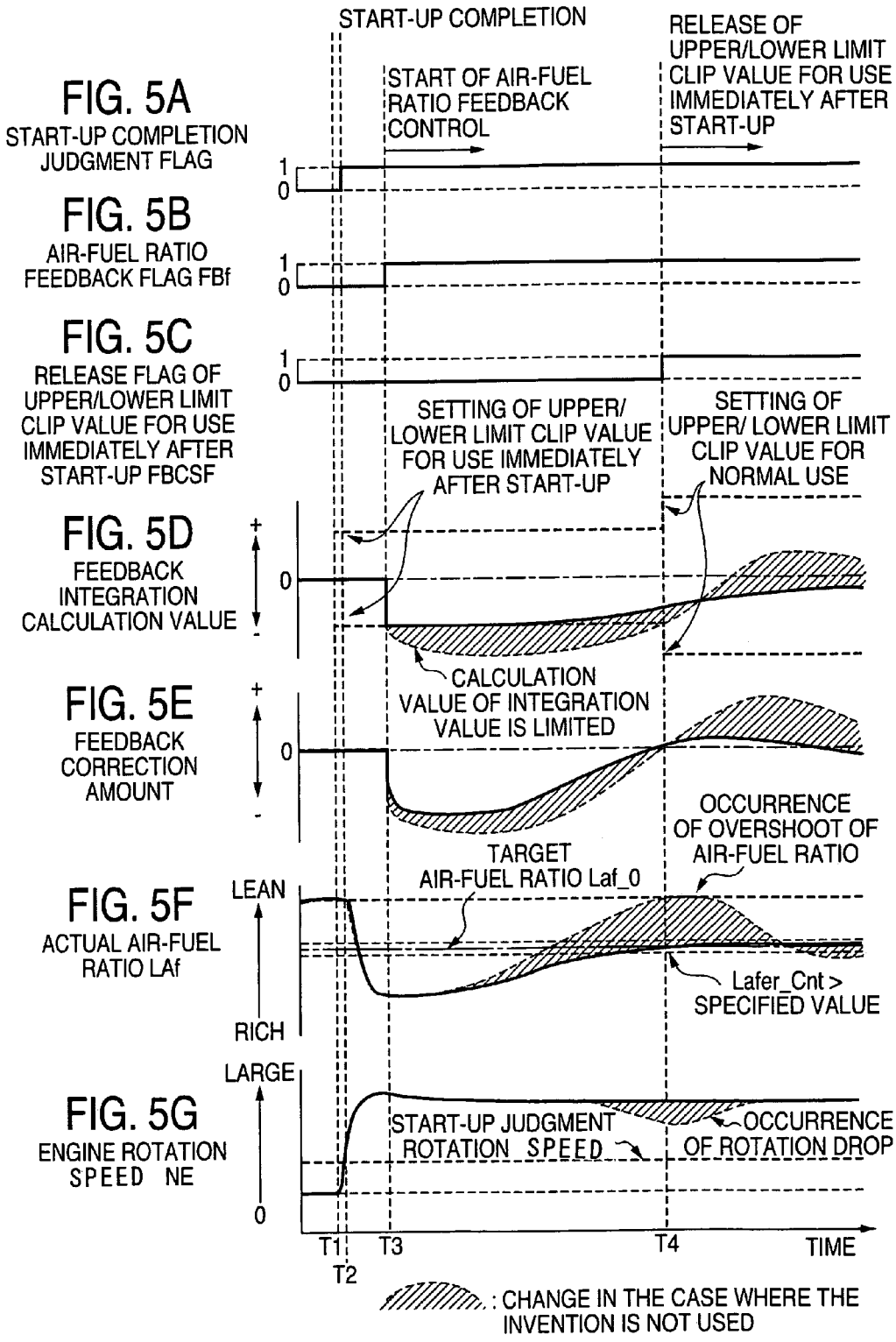
START-UP COMPLETION
RELEASE OF UPPER/LOWER LIMIT CLIP VALUE FOR USE IMMEDIATELY AFTER START-UP
START OF AIR-FUEL RATIO FEEDBACK CONTROL
FIG. 5A
START-UP COMPLETION JUDGMENT FLAG
FIG. 5B
AIR-FUEL RATIO FEEDBACK FLAG FBf
FIG. 5C
RELEASE FLAG OF UPPER/LOWER LIMIT CLIP VALUE FOR USE IMMEDIATELY AFTER START-UP FBCSF
SETTING OF UPPER/ LOWER LIMIT CLIP VALUE FOR USE IMMEDIATELY AFTER START-UP
SETTING OF UPPER/ LOWER LIMIT CLIP VALUE FOR NORMAL USE
FIG. 5D
FEEDBACK INTEGRATION CALCULATION VALUE
CALCULATION VALUE OF INTEGRATION VALUE IS LIMITED
FIG. 5E
FEEDBACK CORRECTION AMOUNT
OCCURRENCE OF OVERSHOOT OF AIR-FUEL RATIO
TARGET AIR-FUEL RATIO Laf_0
FIG. 5F
ACTUAL AIR-FUEL RATIO LAf
LEAN
RICH
Lafer_Cnt > SPECIFIED VALUE
LARGE
FIG. 5G
ENGINE ROTATION SPEED NE
START-UP JUDGMENT ROTATION SPEED
OCCURRENCE OF ROTATION DROP
T1
T2
T3
T4
TIME
: CHANGE IN THE CASE WHERE THE INVENTION IS NOT USED

START OF AIR-FUEL RATIO FEEDBACK CONTROL
LARGE INTEGRATION CONSTANT
OVERSHOOT

AIR-FUEL RATIO FEEDBACK CORRECTION COEFFICIENT
OCCURRENCE OF OVERSHOOT
LEAN
HUNTING

AIR-FUEL RATIO
RICH
OCCURRENCE OF OVER RICH
TARGET AIR-FUEL RATIO
LARGE

ENGINE ROTATION SPEED
ROTATION SPEED LOWERING
0
TIME
0
T1
T2
T3
T4
DELAY TIME

AIR-FUEL RATIO CONTROL APPARATUS FOR INTERNAL COMBUSTION ENGINE

BACKGROUND OF THE INVENTION

1. Field of the Invention

The present invention relates to an air-fuel ratio control apparatus for controlling an air-fuel ratio of an internal combustion engine, and particularly to an air-fuel ratio control apparatus in which air-fuel ratio control immediately after start-up of an internal combustion engine is more suitably performed than a conventional one.

2. Description of the Related Art

As is well known, in an internal combustion engine, for the purpose of improving fuel economy and purifying exhaust gas, the so-called air-fuel ratio feedback control (hereinafter also referred to as air-fuel ratio control) is performed. In the air-fuel ratio feedback control, in general, when an air-fuel ratio sensor mounted in an exhaust passage detects that the air-fuel ratio is in a rich state, a fuel injection amount from an injector (injection valve) is reduced to shift the air-fuel ratio to the lean side. Besides, when the air-fuel ratio sensor detects that the air-fuel ratio is in a lean state, the fuel injection amount from the injection valve is increased to shift the air-fuel ratio to the rich side. By performing the control as state above, the control to cause the air-fuel ratio of the gas passing through the exhaust passage of the internal combustion engine to coincide with the target air-fuel ratio is performed.

Immediately after the internal combustion engine is started, since a state of each portion in the inside of the internal combustion engine is different from a normal condition (for example, temperature is low), when the air-fuel ratio control which is set to be optimally operated in the normal condition is used as it is, there is a possibility that various problems arise. For example, patent document 1 (JP-A-8-312428) discloses a technique in which at the time point of start of the air-fuel ratio feedback control immediately after start-up, an integration constant used for the first integration control toward the lean direction is made larger than a normal value, and the control speed is increased to enhance convergence to the target air-fuel ratio, and further, spark advance control for ignition timing is performed in order to suppress a drop in engine rotation number(rotation speed) which occurs since the air-fuel ratio control is not normally performed at the time of start-up (there are also other causes).

However, in the technique disclosed in patent document 1, especially at the time of cold engine start-up (at the time of start-up from the state where the engine is cold), there is a problem that a good control state can not be immediately obtained. For facilitating the understanding of this, a description will be made while the state immediately after the start-up is schematically shown in FIGS. 9A to 9C. In FIGS. 9A to 9C, the horizontal axis indicates the elapsed time after the start-up, and FIG. 9A shows an air-fuel ratio feedback correction coefficient. Besides, FIG. 9B shows an air-fuel ratio with the passage of time. FIG. 9C shows a change of engine rotation speed. In order to certainly perform the cold start-up, a large amount of fuel must be injected at the time of the start-up. Immediately after the start-up, especially immediately after the cold engine start-up, a temporarily very rich air-fuel ratio is produced by the large amount of fuel injected at the time of the start-up (T1 of FIGS. 9A to 9C). Thus, even if the integration constant of the air-fuel ratio feedback control is made larger than a normal value and the control speed is increased (FIG. 9A), the shift of the air-fuel ratio to the target air-fuel ratio is delayed due to a delay time such as a response delay time of a sensor to detect the air-fuel ratio and a transport delay time of fuel injection amount (till T2 of FIGS. 9A to 9C), and the shift to the target air-fuel ratio does not immediately start. Besides, when the shift of the air-fuel ratio toward the lean direction starts and exceeds the target air-fuel ratio, the air-fuel ratio feedback control toward the rich direction is performed this time. However, as described above, since there is the delay time, the air-fuel ratio does not immediately shift toward the rich direction (T2 to T3 of FIGS. 9A to 9C), and during the delay time, the air-fuel ratio is shifted toward the lean direction excessively since the integration constant used for the first integration control toward the lean direction is made larger than the normal value, that is, the control speed toward the lean direction is increased. Such a state is called overshoot (FIG. 9B). There has been a problem that when the overshoot occurs, the rotation speed is reduced, and a misfire (engine stop) finally occurs.

Further, even if the misfire does not occur, in the air-fuel ratio feedback control, in order to return the overshoot state to the target air-fuel ratio, the air-fuel ratio feedback control is performed significantly toward the rich direction. Thus, there has also been a problem that the air-fuel ratio is put in a hunting state with respect to the target air-fuel ratio, and the convergence to the target air-fuel ratio becomes slow (after T4 of FIGS. 9A to 9C)

Besides, when consideration is given to the existence of the fluctuation in characteristics of commercially available fuel among fuel companies and the fluctuation in characteristics due to the season when the fuel is refined, in the case where the fuel with poor volatility is used at the cold engine start-up (for example, 0° C.), the fuel injected from an injector does not sufficiently vaporize, and an actual amount of fuel sucked into a cylinder becomes less than the injection amount of fuel, and further, when the integration constant of the air-fuel ratio feedback control is made larger than the normal value, and the overshoot of the air-fuel ratio occurs, the amount of supply fuel becomes further excessively small. Therefore, there has also been a problem that the misfire is more liable to occur, and the engine stall becomes liable to occur.

As stated above, in the conventional air-fuel ratio feedback control, there have been problems that especially immediately after the cold engine start-up, the air-fuel ratio is not immediately stabilized, the hunting or overshoot occurs in the temporal change of the air-fuel ratio, and the convergence to the target air-fuel ratio becomes slow, and further, the engine is stalled (stopped) in some cases.

Besides, there has been a problem that it is impossible to sufficiently deal with the fluctuation in the characteristics of commercially available fuel among companies, and the fluctuation in the characteristics due to the refining season.

SUMMARY OF THE INVENTION

The invention has been made to solve the foregoing problems and provides an air-fuel ratio control apparatus for an internal combustion engine in which an influence of fluctuation in fuel characteristics is small, and even immediately after start-up, an actual air-fuel ratio is quickly converged to a target air-fuel ratio without, producing overshoot with respect to the target air-fuel ratio and without causing a stall in engine rotation speed, and drivability is not spoiled.

According to an aspect of the invention, an air-fuel ratio control apparatus for an internal combustion engine includes an air-fuel ratio sensor to detect an air-fuel ratio of the internal combustion engine having a fuel injection unit, an air-fuel ratio feedback control unit that has a calculation unit to calculate a fuel injection amount to make a detection value of the air-fuel ratio sensor coincident with a target air-fuel ratio and controls the fuel injection unit based on the calculated fuel injection amount, a start-up completion judgment unit to judge whether start-up of the internal combustion engine has been completed, an engine condition (state) judgment unit to judge whether the internal combustion engine enters a normal condition after the start-up has been completed, and an upper/lower limit clip setting unit to limit an output range of the calculation unit within a first output range during a period of from a time when the start-up completion judgment unit judges that the start-up has been completed to a time when the engine condition judgment unit judges that the internal combustion engine enters the normal condition.

According to the air-fuel ratio control apparatus for the internal combustion engine according to the invention, immediately after start-up, an upper/lower limit clip value for use immediately after start-up, which is smaller than a normal one, is provided at the output of the calculation circuit to perform calculation for the air-fuel ratio feedback control immediately after start-up and the air-fuel ratio feedback control is performed, and therefore, there is obtained an effect that the actual air-fuel ratio of the internal combustion engine does not overshoot with respect to the target air-fuel ratio, and can be quickly converged to the target air-fuel ratio in a shorter time than a conventional one.

BRIEF DESCRIPTION OF THE DRAWINGS

FIGS. 5A to 5G are timing charts of the first embodiment of the invention.

DETAILED DESCRIPTION OF THE INVENTION

Hereinafter, embodiments of the invention will be described in detail with reference to the drawings.

EMBODIMENT 1

Figure 1:
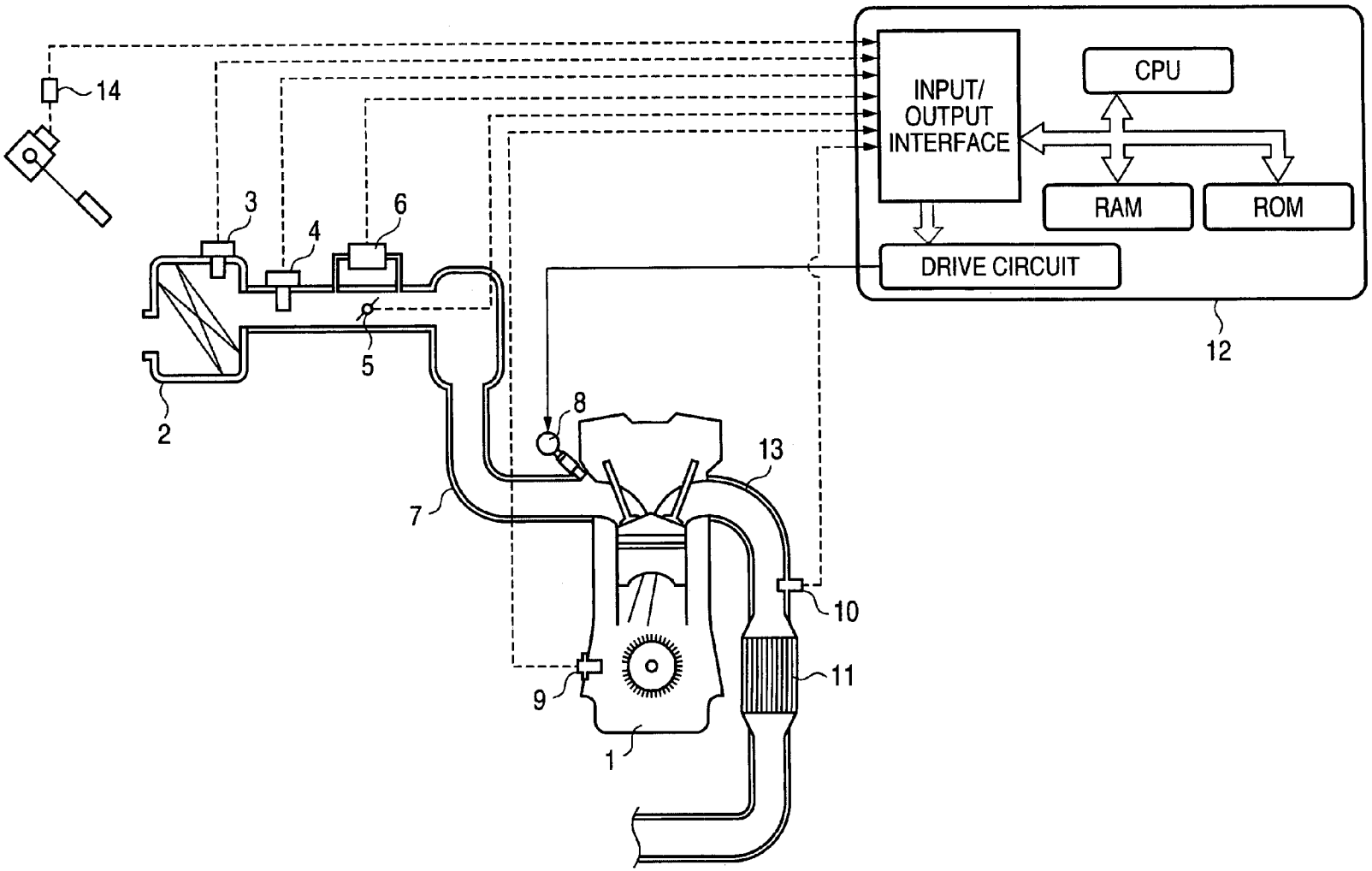
FIG. 1 is a structural view showing a structure of an air-fuel ratio control apparatus for an internal combustion engine according to the invention.

First, an air-fuel ratio control apparatus for an internal combustion engine according to embodiment 1 of the invention will be described. FIG. 1 is an explanatory view showing a state in which for the purpose of describing a structure of an air-fuel ratio control apparatus for an internal combustion engine according to the invention, the air-fuel ratio control apparatus is connected to the internal combustion engine. The internal combustion engine to which the air-fuel ratio control apparatus of the invention can be applied is not a specific one but a very general one. Although the basic structure and operation of such a general internal combustion engine are well known, for facilitating the understanding of the invention, its description will be made on purpose. An internal combustion engine 1 (hereinafter referred to as an engine) is provided with a crank angle sensor 9 capable of detecting an engine rotation speed, together with a crank angle of a crank axis in the engine 1. Dust in air supplied to the engine 1 is removed by an air filter 2. The amount of air flowing into the engine 1 is adjusted by adjusting the opening of a throttle valve 5. An injector (injection valve) 8 is mounted in an intake pipe 7 so that the injection direction of the injector is directed to a combustion chamber direction of the engine 1. A mixed gas is formed of the air adjusted by the throttle valve 5 and fuel injected from the injector 8. This mixed gas is sent to the combustion chamber of the engine 1.

Besides, an intake air temperature sensor 3 to measure the temperature of the intake air and an air flow sensor 4 to measure the air flow amount are mounted between the air filter 2 and the intake pipe 7. Besides, as an idle speed control (hereinafter referred to as ISC), an ISC valve 6 to adjust the idle rotation speed of the engine is mounted. Besides, although not shown, a water temperature sensor to detect the temperature of cooling water of the engine 1 is also mounted.

The mixed gas sent to the combustion chamber of the engine 1 is ignited by an electric spark of a not-shown ignition plug provided in the combustion chamber and is burnt. The gas after combustion (already burnt gas or exhaust gas) passes through an exhaust pipe 13, and an air-fuel ratio of the already burnt gas is detected by an air-fuel ratio sensor 10 provided in the exhaust pipe 13. Besides, the already burnt gas is purified by a catalyst (for example, three-way catalyst) 11 provided at the downstream side of the air-fuel ratio sensor 10 and is exhausted.

An engine control unit (hereinafter referred to as an ECU) 12 includes the following. That is, there are included a ROM (Read Only Memory) storing various constants such as injection fuel at the time of start-up, a RAM (Random Access Memory) temporarily storing calculation values such as a correction value of air-fuel ratio feedback, a CPU (microprocessor) to calculate a basic fuel injection amount and the like from the rotation speed of the engine 1 and the amount of the intake air, an input/output interface to which detection signals of the air-fuel ratio sensor 10 and the like are inputted, and a drive circuit to output a drive signal and the like of the injector 8. The ECU constitutes a part of the air-fuel ratio control apparatus of the invention described below.

The detection signals of various sensors, such as the crank angle sensor 9, are inputted to the ECU 12 through the input/output interface. The ECU 12 judges the operation state of the engine 1 by causing the CPU to perform calculation. Besides, the ECU 12 reads various constants from the ROM based on the detection signals from the air flow sensor 4 and the water temperature sensor, and reads a correction amount of the air-fuel ratio feedback control based on the detection signal of the air-fuel ratio sensor 10 from the RAM. The ECU 12 calculates the fuel injection amount of the injector 8 by the CPU, and performs the control to inject the fuel of the calculated injection amount from the injector 8 through the input/output interface and the drive circuit.

Figure 2:
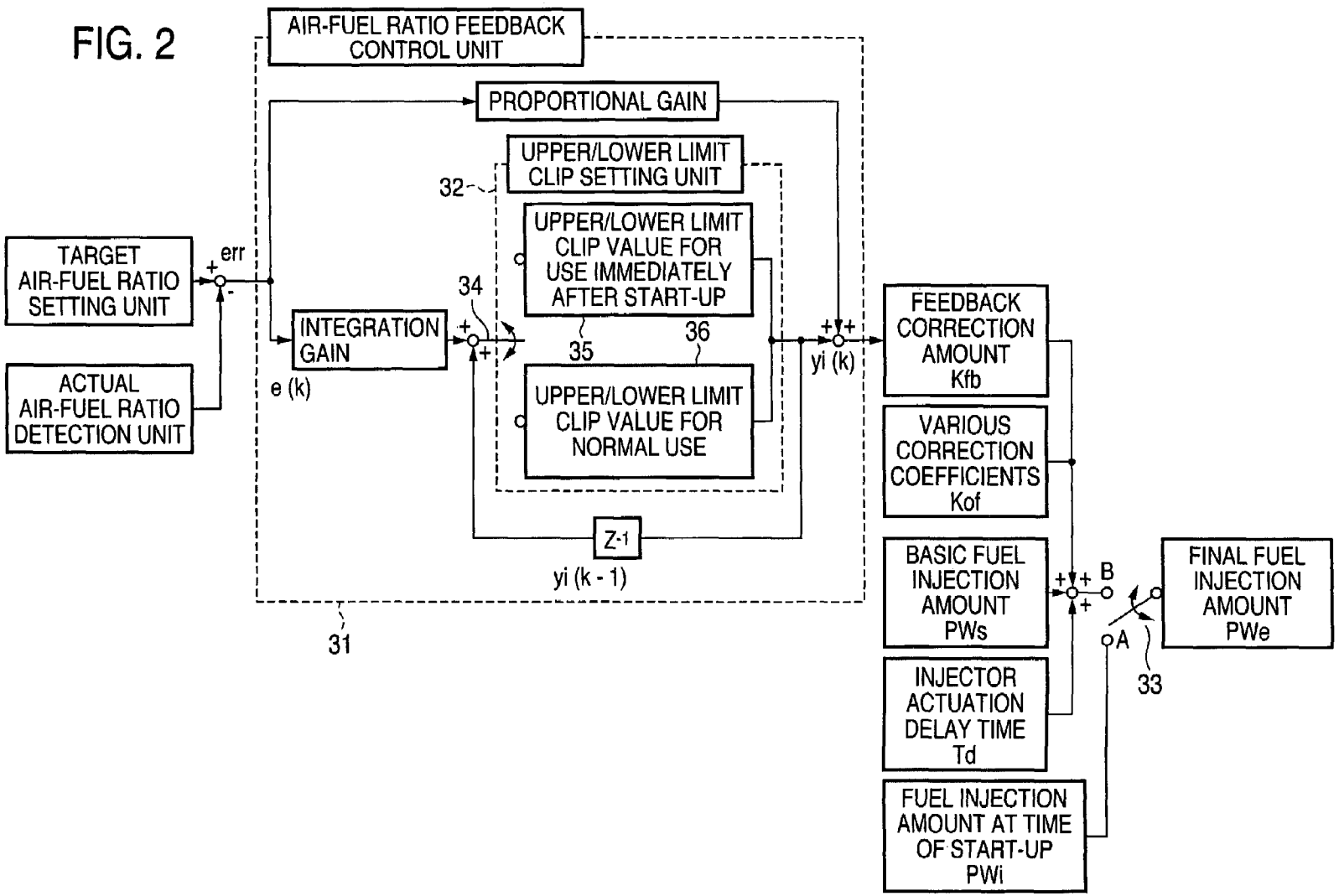
FIG. 2 is a block diagram showing an air-fuel ratio feedback control system of an ECU of FIG. 1.

A further detailed description will be made with reference to FIG. 2. FIG. 2 is a control block diagram for explaining the air-fuel ratio feedback control performed in the inside of the ECU 12. The air-fuel ratio feedback control is performed in such a manner that a difference between a target value of the air-fuel ratio and the air-fuel ratio (called the actual air-fuel ratio) obtained by measuring the exhaust gas exhausted from the engine 1 is obtained, a calculation such as, for example, a differential calculation or an integral calculation is performed based on this difference to calculate a fuel correction amount for controlling increase/decrease of the amount of fuel injected from the injector 8, and the fuel injection amount from the injector 8 is increased/decreased, so that the actual air-fuel ratio coincides with the target air-fuel ratio.

First, the fuel injection amount injected from the injector 8 is determined by coupling a basic fuel injection amount PWs with various correction coefficients Kof added to this, a feedback correction amount Kfb controlled by the air-fuel ratio control, and an activation delay time Td of the injector 8.

Based on a rotation speed NE of the engine 1 calculated by the ECU 12 from the detection signal of the crank angle sensor 9 and an intake air amount Qa from the air flow sensor 4, the basic fuel injection amount PWs is calculated as $$PWs=K\times Qa\times NE(K \text{ is a constant}).$$

A final fuel injection amount PWe is calculated by coupling the basic fuel injection amount PWs with the air-fuel ratio feedback correction coefficient Kfb, the various correction coefficients Kof, and the activation delay time Td of the injector 8.

$$PWe=PWs\times Kfb\times Kof+Td$$

Next, the respective correction amounts Kfb and Kof will be described.

With respect to the air-fuel ratio feedback correction amount Kfb, a difference (err shown in the left portion of FIG. 2) between the target air-fuel ratio corresponding to the operation state of the engine 1 and the air-fuel ratio from the air-fuel ratio sensor 10 is obtained. With respect to the difference, a calculation is performed for each proportion calculation term and each integration calculation term in the inside of the air-fuel ratio feedback control unit 31 in the dotted line of FIG. 2, the respective calculation results are added, and the feedback correction amount is calculated.

Besides, with respect to the various correction coefficients Kof, ones corresponding to the detection values of the sensors are read out from what are previously stored in the ROM in the ECU 12 and are used. For example, a water temperature correction coefficient Kwt is set so that as the water temperature becomes low, the fuel amount is increased.

As shown in FIG. 2, an upper/lower limit clip setting unit 32 is provided in an output part of an integration calculation circuit of the air-fuel ratio feedback control unit 31, an output value of the integration calculation does not exceed the clip value set by the upper/lower limit clip setting unit 32, and the air-fuel ratio feedback control is performed within the range of the clip value as described above.

Here, the structure of the upper/lower limit clip setting unit 32 will be described. The upper/lower limit clip setting unit 32 includes plural limiters (FIG. 2 shows the case of two kinds) different from each other in level, and a switch 34 to select one of the plural limiters. Incidentally, it is needless to say that these functions may be achieved by the CPU of FIG. 1, and it is not necessary that these are limited to what is constructed by hardware. The two kinds of limiters of FIG. 2 are an upper/lower limit clip value 35 for use immediately after start-up and an upper/lower limit clip value 36 for normal use. The setting level of the upper/lower limit clip value 35 for use immediately after start-up is set to a value of, for example, 10% to 50% of the setting level of the upper/lower limit clip value 36 for normal use.

Next, the operation of the air-fuel ratio control apparatus of embodiment 1 of the invention will be described in detail with reference to a flowchart of FIG. 3.

Figure 3:
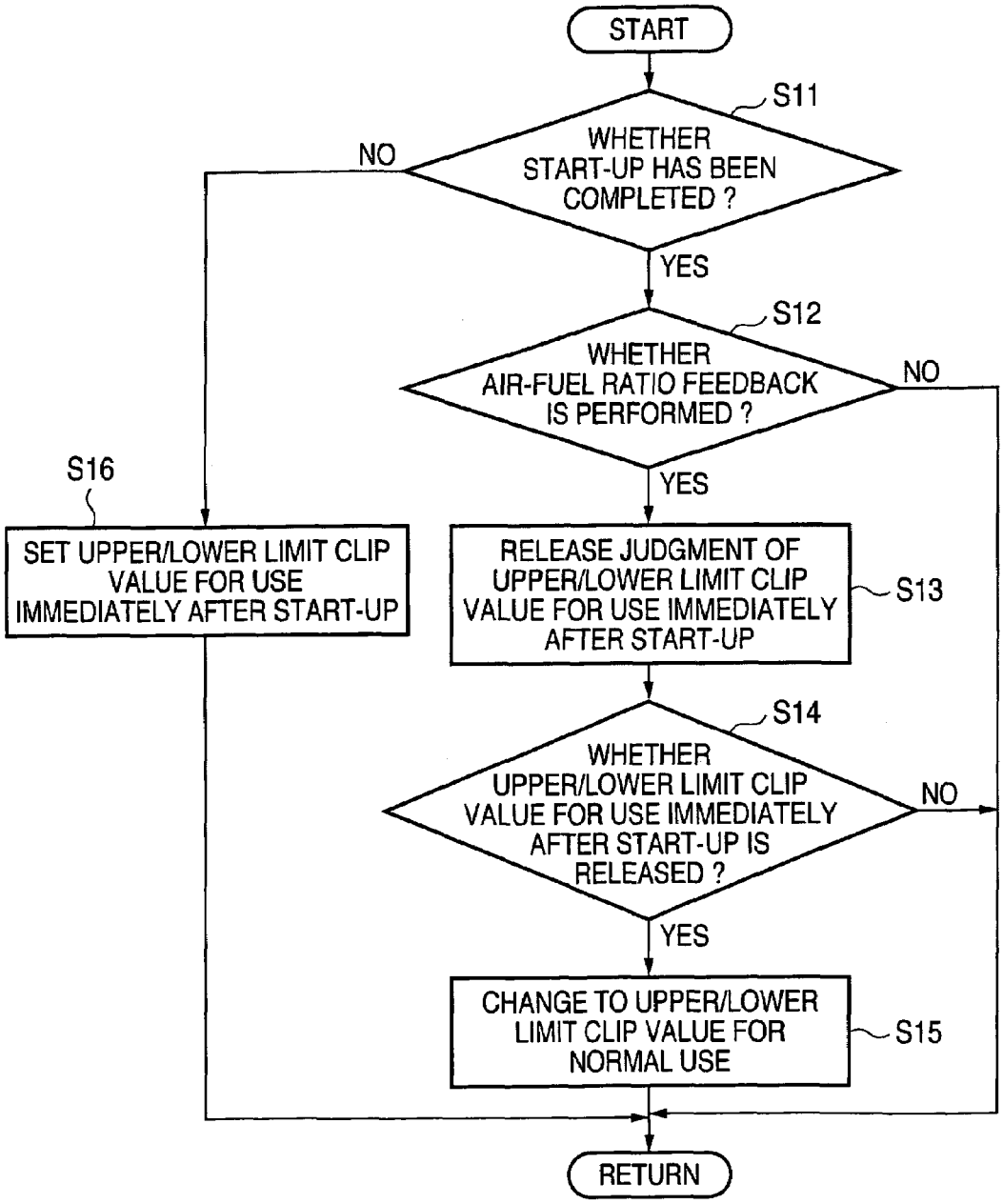
FIG. 3 is an operation flowchart of a control block of FIG. 2.

First, before the detailed description of FIG. 3 is made, the flow of the flowchart will be roughly described. A signal is sent to the ECU 12 from a not-shown start switch of the engine 1, cranking is started in the engine 1, start-up time fuel (called PWi) is injected from the injector 8 according to the output signal of the crank angle sensor 9 at a specified timing, the combustion of the mixed gas occurs, and the engine 1 starts up. At the time of the start-up, the switch 33 of FIG. 2 is connected to the side of A of FIG. 2, and the air-fuel ratio feedback control unit 31 is separated from the circuit. That is, at the time of the start-up, since a larger amount of fuel than a normal fuel injection amount is injected in order to certainly carry out the first ignition and to start up the engine 1, the previously set start-up time fuel injection amount PWi is used. PWi is not a fixed value, but is stored as a table in the ROM of the ECU 12 so that for example, as the water temperature of the engine 1 becomes low, the initial fuel injection amount becomes large, is read from the ROM according to the detection signal of the not-shown water temperature sensor, and is injected from the injector 8.

When the start-up of the engine 1 is completed (for example, the engine rotation speed reaches a specified level), the switch 33 of FIG. 2 is switched from the fuel injection control side (A in the drawing) at the time of the start-up to the normal fuel injection control side (B in the drawing).

In the normal fuel injection amount control, the ECU calculates the basic fuel injection amount PWs to achieve the theoretical air-fuel ratio from the rotation speed of the engine 1 based on the detection signal of the crank angle sensor 9 and the intake air amount based on the detection signal of the air flow sensor 4, and calculates the final fuel injection amount (called PWe) in which the correction amounts such as the water temperature correction coefficient Kwt are added, and then, the injector 8 is driven to inject the fuel.

The above-mentioned control is performed in the procedure shown in the flowchart of FIG. 3. That is, when the ECU 12 is powered on, the start of the flowchart shown in FIG. 3 and the following are executed. First, at step S11, the ECU judges whether or not the start-up of the engine 1 has been completed. This judgment is performed based on a start-up completion judgment flag of the engine 1. For example, setting is made such that when the rotation speed of, the engine 1 is 500 r/min or more, a judgment that the start-up has been completed is made, and the start-up completion flag is set to 1.

In the case of NO judgment at S11, since the engine 1 is still in a cranking state or the engine 1 is in a state where engine 1 does not completely start up due to bad start-up, advance is made to S16, the upper/lower limit clip value 35 for use immediately after start-up (in the upper/lower limit clip setting unit 32 of FIG. 2, the switch 34 selects the upper/lower limit clip value 35 for use immediately after start-up) is set, and return is made. In the case of YES judgment at S11, since the start-up of the engine 1 has been completed, advance is made to S12.

At S12, for example, based on a judgment as to whether or not the air-fuel ratio sensor 10 is activated, a judgment is made as to whether or not the air-fuel ratio feedback control is performed. The setting is made such that for example, when the sensor element temperature of the air-fuel ratio sensor 10 is a specified value (for example, 350° C.) or higher, it is judged that the air-fuel ratio sensor 10 is activated. In the case of YES judgment at S12, since the air-fuel ratio feedback control is performed, advance is made to S13, and a release judgment of the upper/lower limit clip value for use immediately after start-up is made. However, in the case of NO judgment, return is made.

When advance is made to S13, it is judged whether the flag FBCSF to instruct the release of the upper/lower limit clip value for use immediately after start-up is set. The unit to make the release judgment (S13) of the upper/lower limit clip value for use immediately after start-up is an engine condition judgment unit in the invention, and in embodiment 1, the judgment is made by a flowchart shown in FIG. 4. In embodiment 2, it is made by a flowchart of FIG. 6, and in embodiment 3, it is made by a flowchart of FIG. 7. They will be respectively described later in detail.

Figure 4:
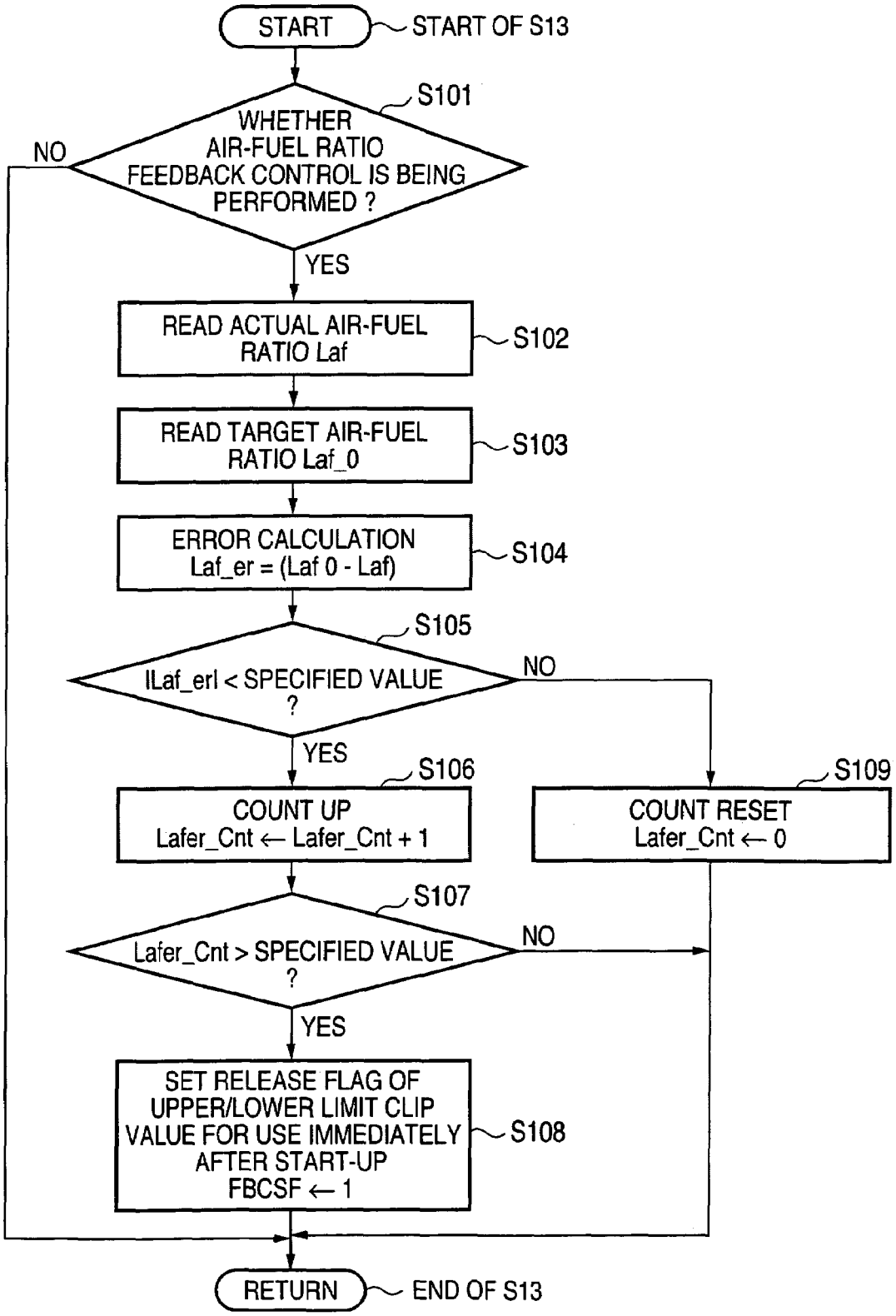
FIG. 4 is a sub-flowchart of a first embodiment of the invention.

The flowchart of FIG. 4 is repeated every specified time, and the details will be described later. At S13, in the case where the release flag FBCSF of the upper/lower limit clip value for use immediately after start-up is set to 1, since the judgment at S14 becomes YES judgment, advance is made to S15, the upper/lower limit clip value for use immediately after start-up is released, the upper/lower limit clip value for normal use is set (in the upper/lower limit clip setting unit 32 of FIG. 2, the switch 34 selects the upper/lower limit clip value 36 for normal use), and return is made. By this, the air-fuel ratio feedback control with the upper/lower limit clip value 35 for use immediately after start-up is ended and the air-fuel ratio feedback control with the upper/lower limit clip value 36 for normal use is started. On the other hand, in the case where the release flag FBCSF of the upper/lower limit clip value for use immediately after start-up is zero at S13, the judgment at S14 becomes NO judgment, and return is made.

Here, the release judgment flow of the upper/lower limit clip value for use immediately after start-up will be described with reference to FIG. 4. The unit to perform the flow of FIG. 4 is one method of plural methods of the engine condition (state) judgment unit as stated above, and will be called an air-fuel ratio control state judgment unit. First, at S101, a judgment is made as to whether or not the air-fuel ratio feedback control is being performed, and in the case of NO judgment, return is made, and in the case of YES judgment, advance is made to S102. At S102, based on the detection signal from the air-fuel ratio sensor 10, the actual air-fuel ratio Laf calculated in the ECU 12 is read, and at S103, the target air-fuel ratio Laf_0 is read.

At S104, a difference Laf_er is calculated from the actual air-fuel ratio Laf and the target air-fuel ratio Laf_0 read at S102 and S103. As shown in FIG. 3, the difference Laf_er is equal to what is obtained when the correction calculation at the time of the air-fuel ratio feedback control is performed.

Then, advance is made to S105, and a judgment is made as to whether the difference Laf_er between the actual air-fuel ratio Laf and the target air-fuel ratio Laf_0 is within a specified value. This specified value indicates how closely the air-fuel ratio detected by the air-fuel ratio sensor 10 approaches the target air-fuel ratio, and is set to, for example, 0.3. When the difference Laf_er between the actual air-fuel ratio Laf and the target air-fuel ratio Laf_0 is within the specified value, that is, when the judgment at S105 is YES, advance is made to S106. On the other hand, when NO judgment is made at S105, that is, when the difference Laf_er between the actual air-fuel ratio Laf and the target air-fuel ratio Laf_0 is outside the specified value, advance is made to S109, an after-mentioned count Lafer_Cnt is reset to zero, and return is made.

When YES judgment is made at S105 and advance is made to S106, the count Lafer_Cnt is incremented by 1. The count Lafer_Cnt is the count incremented only when the difference Laf_er between the actual air-fuel ratio Laf and the target air-fuel ratio Laf_0 continues within the specified value, and by this count, the judgment can be made as to whether or not the actual air-fuel ratio Laf is converged to the target air-fuel ratio Laf_0, and it is used at an after-mentioned convergence judgment at S107.

When the count Lafer_Cnt is incremented by 1 at S106 and advance is made to S107, a judgment is made as to whether or not the count Lafer_Cnt is larger than a specified value. This specified value is experimentally obtained, and is set to, for example, 20. At S107, when the count Lafer_Cnt is smaller than the specified value, that is, when NO judgment is made, since it is necessary to continue the air-fuel ratio feedback control in which the upper/lower limit clip value 35 for use immediately after start-up is set, return is made. On the other hand, in the case of YES judgment in which the count Lafer_Cnt is larger than the specified value, since the actual air-fuel ratio Laf is converged to the target air-fuel ratio Laf_0 and the upper/lower limit clip value for use immediately after start-up can be released, advance is made to S108, the release flag FBCSF of the upper/lower limit clip value for use immediately after start-up is set to 1, and return is made. The release flag FBCSF of the upper/lower limit clip value for use immediately after start-up is set to 1, so that resetting can be made at any time to the upper/lower limit clip value for normal use.

As described above, the air-fuel ratio control state judgment unit repeatedly reads the detection value of the air-fuel ratio sensor at specified time intervals, and when the state in which the deviation from the target air-fuel ratio is within the predetermined range is continuously detected a specified number of times, it is judged that the air-fuel ratio is controlled within the deviation range previously determined with respect to the target air-fuel ratio.

Next, in embodiment 1 of the invention, temporal change states of various control values in timing charts of FIGS. 5A to 5G will be described by use of an example. Incidentally, in order to indicate the effect of the invention, in FIGS. 5A to 5G, the change of a control value in the case where the invention is not used is indicated by a dotted line, the change of a control value in the case where the invention is used is indicated by a solid line, and a difference between both is indicated by an oblique line.

At time T1, when the driver turns on a key to start up the engine 1, the ECU 12 is powered on, a not-shown starter is rotated, start-up fuel injection is performed, and the upper/lower limit clip value for use immediately after start-up 35 is set before the start-up completion flag becomes 1. At time T2, when the-rotation speed of the engine becomes a specified rotation speed or higher, the start-up completion flag (FIG. 5A) is set to 1. Besides, at time T1, the ECU 12 is powered on, and at the same time, energization control to a heater of the air-fuel ratio sensor 10 is started, and the element of the air-fuel ratio sensor is heated. When the element of the air-fuel ratio sensor 10 is heated to a specified temperature or higher at time T3, it is judged that the air-fuel ratio sensor 10 is activated, the air-fuel ratio feedback flag becomes 1, and the air-fuel ratio feedback control is started.

When the air-fuel ratio feedback control is started at time T3, the air-fuel ratio feedback correction amount is calculated according to the difference between the actual air-fuel ratio Laf at that time and the target air-fuel ratio Laf_0. Immediately after the start-up, the, influence of a large amount of fuel injected at the time of the start-up remains, and the actual air-fuel ratio Laf indicates the rich state, and accordingly, the integration calculation is performed so that the correction is made to the lean side by the air-fuel ratio feedback control, that is, the fuel injection amount is decreased.

In the case where the upper/lower limit clip of the integration calculation is a normal value at the time of the calculation of the air-fuel ratio feedback correction amount (that is, in the case where the invention is not used), the calculation of the feedback correction amount produces the calculation result to significantly decrease the fuel injection amount in order to return the actual air-fuel ratio Laf to the target air-fuel ratio Laf_0. Thus, the shift start time of the actual air-fuel ratio Laf to the target air-fuel ratio Laf_0 is early. However, since the injection fuel amount is significantly reduced, the overshoot in which the actual air-fuel ratio Laf exceeds the target air-fuel ratio Laf_0 occurs, and the engine rotation number (rotation speed) is also reduced (as indicated by the dotted line of FIGS. 5F and 5G).

In the case where the upper/lower limit clip value for use immediately after start-up is set (in the case where the invention is used), first, although the calculation of the air-fuel ratio feedback correction amount is performed as usual, since the upper/lower limit clip value for use immediately after start-up is set for the integration calculation of the air-fuel ratio feedback correction, the integration calculation value of the air-fuel ratio feedback correction is limited (oblique line part of FIG. 5D), and accordingly, the final feedback correction amount is also limited (oblique line part of FIG. 5E). Since the significant reduction of the fuel injection amount is eliminated by the limitation of the feedback correction amount by the upper/lower limit clip value for use immediately after start-up, as compared with the case where the upper/lower limit clip of the foregoing integration calculation is the normal value, the shift start time from the rich state of the actual air-fuel ratio Laf is late. However, the actual air-fuel ratio Laf does not overshoot with respect to the target air-fuel ratio Laf_0 (oblique line part of FIG. 5F), and is converged to the target air-fuel ratio Laf_0, and a drop in the engine rotation number(rotation speed) (oblique line part of FIG. 5G) does not occur (time: from T3 to T4).

The actual air-fuel ratio Laf is converged to the target air-fuel ratio Laf 0, and when the difference Laf_er between the actual air-fuel ratio Laf and the target air-fuel ratio Laf_0 is within the specified value and the count Lafer_Cnt becomes larger than the specified number of times, the release flag FBCSF of the upper/lower limit clip value for use immediately after start-up becomes 1, the upper/lower limit clip value for use immediately after start-up is released, the upper/lower limit clip value for normal use is set, and the air-fuel ratio feedback control with the upper/lower limit clip value for use immediately after start-up is ended (time: T4).

According to the first embodiment of the invention, since the upper/lower limit clip value for use immediately after start-up is set in the air-fuel ratio feedback integration calculation, even if the air-fuel ratio feedback control is started from the state where the actual air-fuel ratio is in the rich state, the influence of the start-up fuel injection amount is removed, and the actual air-fuel ratio does not overshoot with respect to the target air-fuel ratio and can be quickly converged to the target air-fuel ratio.

Besides, when the case where the difference between the actual air-fuel ratio and the target air-fuel ratio is within the specified value is repeatedly measured a specified number of times, the upper/lower limit clip value for use immediately after start-up is changed to the upper/lower limit clip value for normal use. Thus, the upper/lower limit clip value is returned to the normal value in a suitable time, and the control performance of the air-fuel ratio feedback at the time of immediately after start-up and that at the normal time can be made consistent with each other.

EMBODIMENT 2

Next, embodiment 2 of the invention will be described. In an air-fuel control apparatus of embodiment 2, the structure of the engine 1 of FIG. 1 and the flowchart of FIG. 3 are similarly applied. The release judgment of the upper/lower limit clip value for use immediately after start-up at S13 of FIG. 3 becomes a sub-flowchart shown in FIG. 6, and a timer is actuated at the same time as the start of the air-fuel ratio feedback control.

Figure 6:
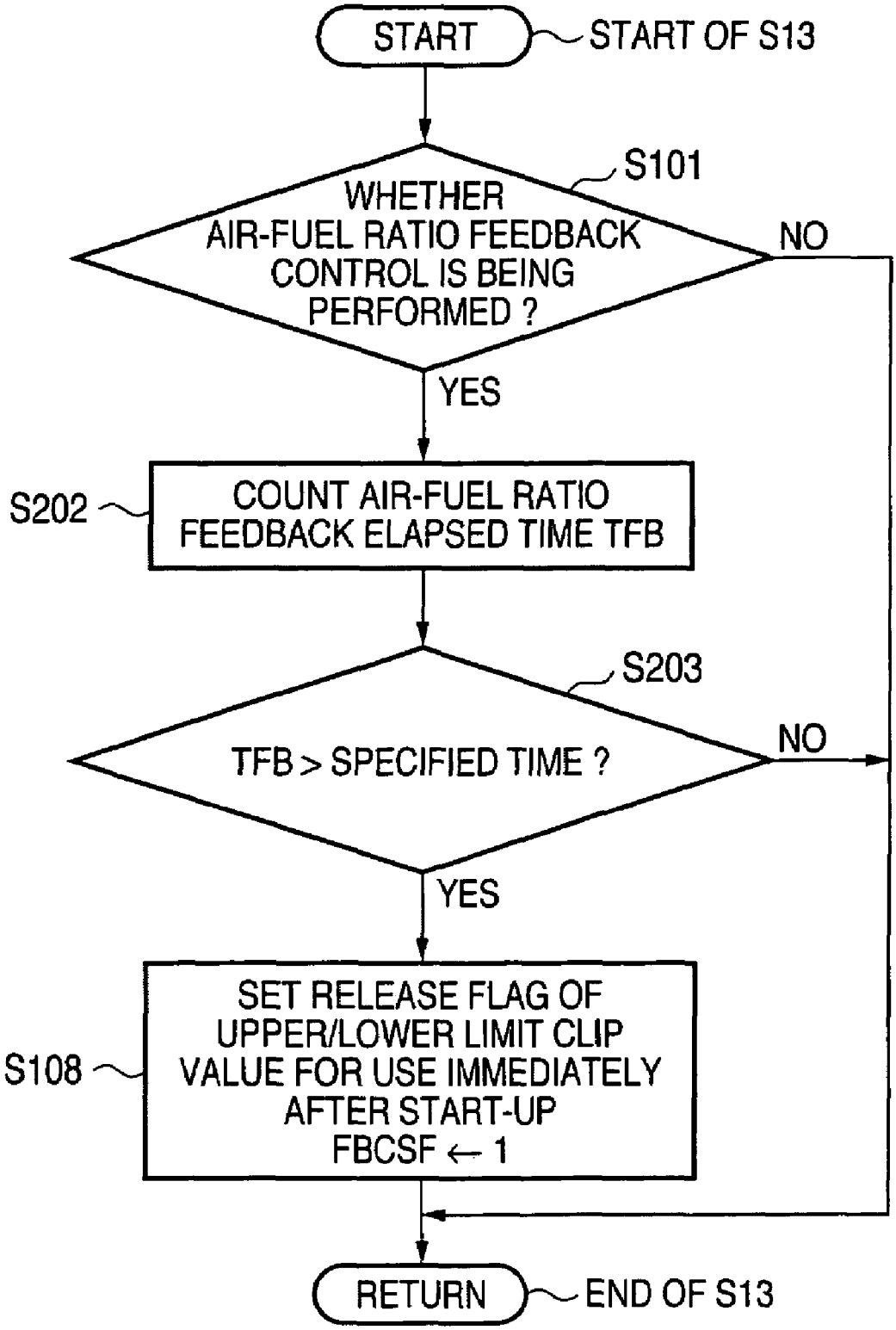
FIG. 6 is a sub-flowchart of a second embodiment of the invention.

Since the flowchart of FIG. 3 is not changed, its description will be omitted. Only a modification part will be described with reference to FIG. 6. The sub-flowchart of FIG. 6 is also performed every specified time similarly to embodiment 1. First, at S101, a judgment is made as to whether or not the air-fuel ratio feedback control is being performed. This judgment is the judgment similar to embodiment 1, and in the case of YES judgment, advance is made to S202, and in the case of NO judgment, return is made.

When advance is made to S202, an air-fuel ratio feedback control elapsed time TFB starts to be counted, advance is made to S203, and a judgment is made as to whether or not the air-fuel ratio feedback control elapsed time TFB is a specified time or more. This specified time is experimentally obtained, is set to a time in which the actual air-fuel ratio is certainly converged to the target air-fuel ratio, and is set to a value of approximately 4 to 10 seconds, for example, 4 seconds. This time length may be changed according to conditions, for example, cooling water temperature. A time in which the engine reaches a normal condition(state) is short when the cooling water temperature is high, and is long when it is low. Thus, a not-shown timer time adjustment unit (program inside the ECU) is used, and based on, for example, the detection value of the water temperature sensor, the time length may be made long when the water temperature is low, and it may be made short when the water temperature is high.

At S203, when YES judgment is made, that is, the air-fuel ratio feedback control elapsed time TFB becomes the specified time or more, since it is expected that the actual air-fuel ratio is converged to the target air-fuel ratio, advance is made to S108. On the other hand, when NO judgment is made, that is, the air-fuel ratio feedback control elapsed time TFB is the specified time or less, since it is necessary to further continue the air-fuel ratio feedback control in which the upper/lower limit clip value for use immediately after start-up is set, return is made. When advance is made to S204, the release flag FBCSF of the upper/lower limit clip value for use immediately after start-up is set to 1, and return is made.

Then, return is made to the flowchart of FIG. 3, and in the case where the release flag FBCSF of the upper/lower limit clip value for use immediately after start-up is set to 1 in the sub-flowchart of FIG. 6, since the judgment at S14 is the YES judgment, advance is made to S15, the upper/lower limit clip value for use immediately after start-up is released, the upper/lower limit clip value for normal use is set, and return is made. By this, the air-fuel ratio feedback control with the upper/lower limit clip value for use immediately after start-up is ended, and the air-fuel ratio feedback control with the upper/lower limit clip value for normal use is started. On the other hand, in the case where the release flag FBCSF of the upper/lower limit clip value for use immediately after start-up is zero at S13, the judgment at S14 becomes NO judgment, and return is made.

According to embodiment 2, since the upper/lower limit clip value for use immediately after start-up is changed to the upper/lower limit clip value for normal use according to the feedback timer TFB for use immediately after start-up, the effective period of the upper/lower limit clip value for use immediately after start-up is limited to the specified time from the start-up, and the air-fuel ratio feedback control performance at the normal time can be certainly ensured.

EMBODIMENT 3

Figure 7:
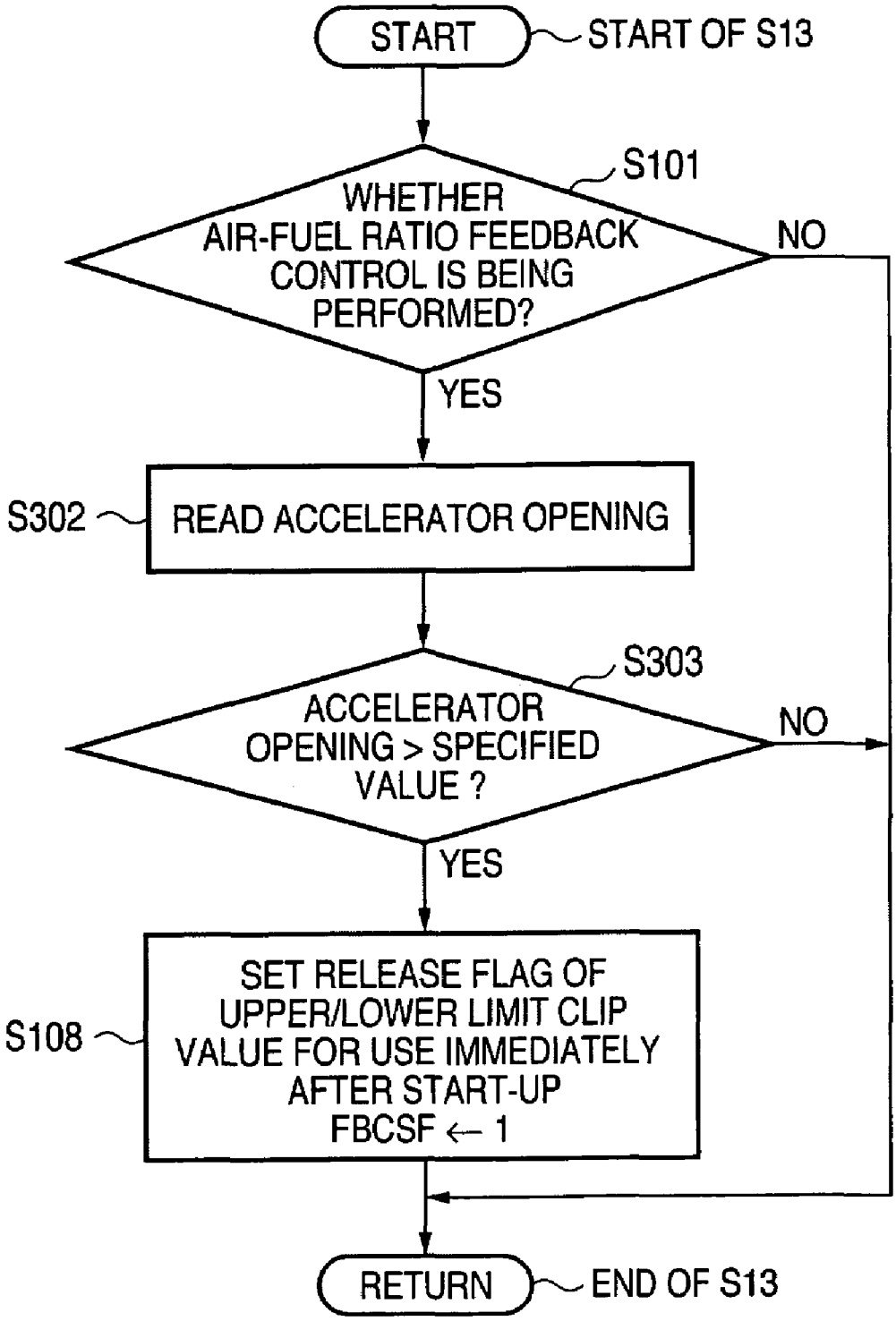
FIG. 7 is a sub-flowchart of a third embodiment of the invention.

Next, embodiment 3 will be described. Also in embodiment 3, FIGS. 1 and 3 are not changed, and since a sub-flowchart of release judgment of upper/lower limit clip value for use immediately after start-up at S14 of FIG. 3 (that is, engine state(condition) judgment unit) is changed as shown in FIG. 7, only the modification part will be described.

First, at S101, similarly to the first or the second embodiment, a judgment is made as to whether or not the air-fuel ratio feedback control is being performed, and in the case of YES judgment, advance is made to S302, and in the case of NO judgment, return is made. When advance is made to S302, an accelerator opening is read. The accelerator opening is read by a not-shown accelerator opening detection unit. Next, when advance is made to S303, a judgment is made as to whether or not the accelerator opening read at S302 is a specified value or more. This specified value is set to such a value that a judgment that the accelerator is pressed is not made when the accelerator is not pressed. For example, in the case where the operation range of the opening is 0 to 100%, it is judged that the accelerator is pressed when the opening is 5% or more. When the accelerator is pressed, since YES judgment is made, advance is made to S304, and when it is not pressed, since NO judgment is made, return is made.

When YES judgment is made at S303 and advance is made to S108, the release flag FBCSF of the upper/lower limit clip value for use immediately after start-up is set to 1, and return is made. Since judgment at S14 of the flowchart of FIG. 3 is YES judgment, advance is made to S15, the upper/lower limit clip value for use immediately after start-up is released, the upper/lower limit clip value for normal use is set, and return is made. By this, the air-fuel ratio feedback control with the upper/lower limit clip value for use immediately after start-up is ended and the air-fuel ratio feedback control with the upper/lower limit clip value for normal use is performed. On the other hand, in the case where the release flag FBCSF of the upper/lower limit clip value for use immediately after start-up is zero at S13, the judgment at S14 becomes NO judgment, and return is made.

According to embodiment 3, since the upper/lower limit clip value for use immediately after start-up is changed to the upper/lower limit clip value for normal use according to the operation of the accelerator opening, even in the case where pulling away is performed immediately after the start-up, the air-fuel ratio feedback control performance at the normal time can be ensured. That is, based on the operation of the accelerator opening, the upper/lower limit clip value for use immediately after start-up is changed to the upper/lower limit clip value for normal use, and accordingly, when the accelerator is pressed immediately after the start-up, the correction of the air-fuel ratio feedback control is not made excessively small, and the misfire or engine stall does not occur.

EMBODIMENT 4

Figure 8:
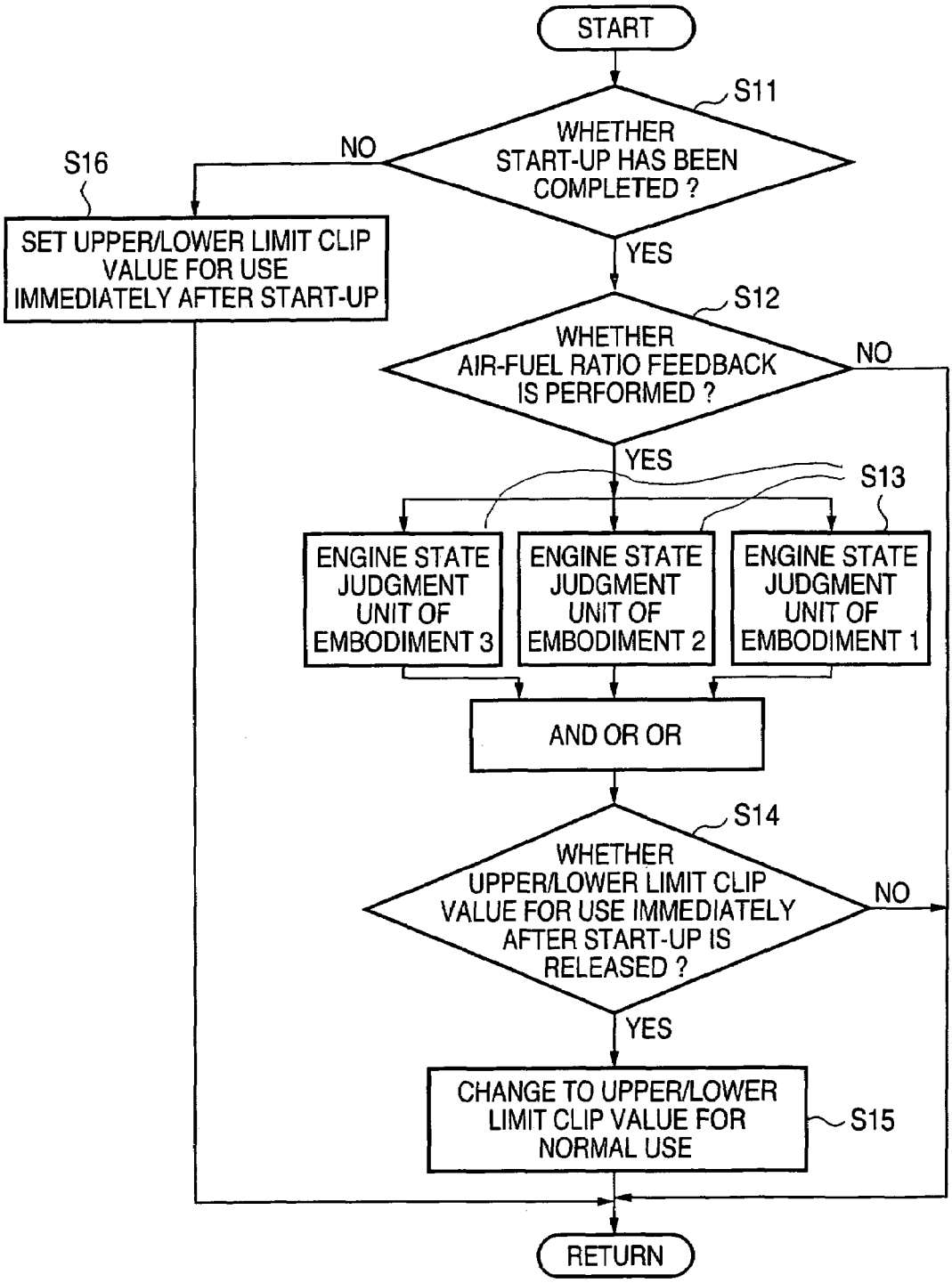
FIG. 8 is an operation flowchart of a control block of a fourth embodiment of the invention.
Figures 9A, 9B, 9C:
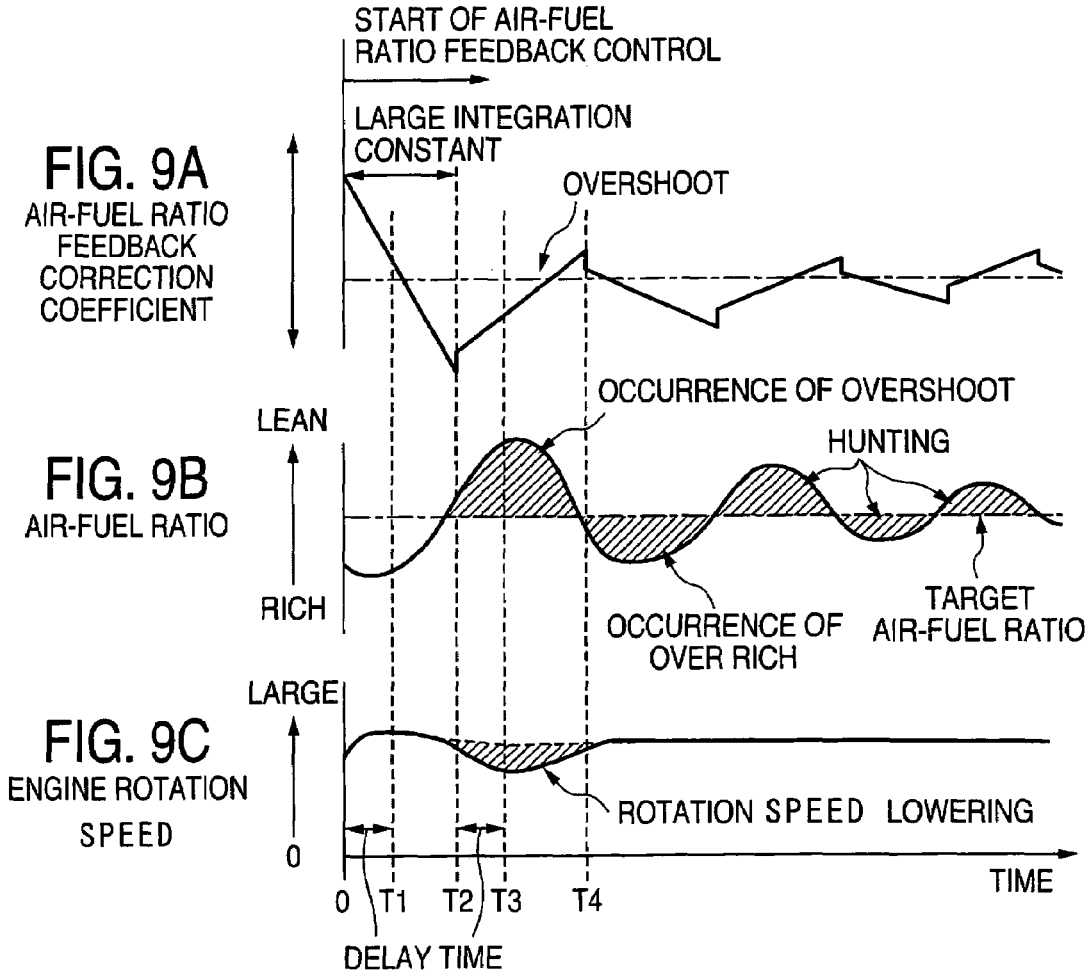
FIGS. 9A to 9C are characteristic views for explaining a state of an engine immediately after an engine is started using an air-fuel ratio control apparatus disclosed in patent document 1.

In embodiments 1, 2 and 3, the engine condition judgment unit checks the control state of the air-fuel ratio, the elapsed time of the timer after the start-up, or whether the accelerator is operated, so that the judgment is made as to whether the engine is shifted from the state immediately after start-up to the normal condition. In the description of embodiments 1 to 3, the description in which one of these methods is performed has been made. However, these three methods (or arbitrary two of them) may be simultaneously performed. A flowchart of the air-fuel ratio control immediately after start-up in such a case is shown in FIG. 8. FIG. 8 shows an example in which the engine condition(state) judgment units of embodiments 1, 2 and 3 are simultaneously performed. In the case where the two or three methods are simultaneously adopted, a condition based on which the engine condition judgment unit judges that the internal combustion engine is shifted to the normal condition may be the logical product AND of the judgment results of the respective methods or the logical sum OR thereof, or the AND/OR may be changed according to the driving operation.

In the case where the logical product AND is adopted, since the upper/lower limit clip value for use immediately after start-up is released at the time point when the judgment results of all the methods indicate the normal condition (state), the result corresponds to the timing when the judgment of the normal condition is made latest among the methods used. In the case where the logical sum OR is adopted, since the shift to the normal condition is performed at the time point when the first one judgment result among all the methods indicates the normal condition, the result corresponds to the timing when the judgment of the normal state is made earliest among the methods used. By adopting such a structure, there is obtained an effect that for example, even in the case where one of the three methods goes wrong, the air-fuel ratio control immediately after start-up is normally performed.

The air-fuel ratio control apparatus for the internal combustion engine according to the invention can be applied to any internal combustion engine irrespective of the ignition method as long as the internal combustion engine is such that the fuel injection amount can be controlled. Besides, the internal combustion engine to be used is not limited to one for a vehicle, and the invention can be used for the internal combustion engine of a motor bicycle, a ship, or an airplane.

What is claimed is:

1. An air-fuel ratio control apparatus for an internal combustion engine, comprising:

an air-fuel ratio sensor to detect an air-fuel ratio of the internal combustion engine having a fuel injection unit;

an air-fuel ratio feedback control unit that has a calculation unit to calculate a fuel injection amount of the fuel injection unit to make a detection value of the air-fuel ratio sensor coincident with a previously given target air-fuel ratio and controls the fuel injection unit based on the fuel injection amount;

a start-up completion judgment unit to judge whether the internal combustion engine is in a state where start-up has been completed;

an engine condition judgment unit to judge whether the internal combustion engine enters a normal condition after the start-up has been completed; and an upper/lower limit clipping unit that limits a maximum output of the calculation unit to an arbitrary first output range until the time when the engine condition judgment unit judges that the internal combustion engine enters the normal condition from the time when the start-up completion judgment unit judges that the start-up has been completed.

2. The air-fuel ratio control apparatus for the internal combustion engine according to claim 1, wherein the first output range is within a range of 10% to 50% of an output range at a time when the limitation of the first output range is released.

3. The air-fuel ratio control apparatus for the internal combustion engine according to claim 2, wherein after the engine condition judgment unit judges that the internal combustion engine enters the normal condition, the upper/lower limit clipping unit releases the limitation of the first output range.

4. The air-fuel ratio control apparatus for the internal combustion engine according to claim 1, further comprising an air-fuel ratio control state judgment unit to judge whether a difference between the air-fuel ratio detected by the air-fuel ratio sensor and the target air-fuel ratio is controlled within a previously determined deviation range, wherein the engine condition judgment unit judges that the internal combustion engine enters the normal condition when the air-fuel ratio control state judgment unit judges that the difference between the air-fuel ratio and the target air-fuel ratio is controlled within the specified deviation range.

5. The air-fuel ratio control apparatus for the internal combustion engine according to claim 4, wherein the air-fuel ratio control state judgment unit reads the detection value of the air-fuel ratio sensor repeatedly at specified time intervals, and when a state in which a deviation from the target air-fuel ratio is within a previously determined range is continuously detected a specified number of times, the air-fuel ratio control state judgment unit judges that the air-fuel ratio is controlled within the deviation range previously determined with respect to the target air-fuel ratio.

6. The air-fuel ratio control apparatus for the internal combustion engine according to claim 1, further comprising a timer that is activated when the start-up completion judgment unit judges that the start-up has been completed, wherein the engine condition judgment unit judges that the internal combustion engine enters the normal condition when the timer exceeds a previously determined time.

7. The air-fuel ratio control apparatus for the internal combustion engine according to claim 6, further comprising:

a water temperature sensor to measure water temperature of cooling water of the internal combustion engine; and a timer time adjustment unit to control the specified time of the timer based on the measured water temperature of the water temperature sensor.

8. The air-fuel ratio control apparatus for the internal combustion engine according to claim 1, further comprising an accelerator opening detection unit to detect an accelerator opening of the internal combustion engine, wherein the engine condition judgment unit judges that the internal combustion engine enters the normal condition when the accelerator opening exceeds a previously determined accelerator opening after the start-up completion judgment unit judges that the start-up has been completed.

9. The air-fuel ratio control apparatus for the internal combustion engine according to claim 1, wherein the calculation unit includes an integration calculation circuit to integrate a difference between the target air-fuel ratio and an actual air-fuel ratio, and the upper/lower limit clip setting unit limits output of the integration calculation circuit.

10. An air-fuel ratio control apparatus for an internal combustion engine, comprising:

an air-fuel ratio sensor to detect an air-fuel ratio of the internal combustion engine having a fuel injection unit;

an air-fuel ratio feedback control unit that has a calculation unit to calculate a fuel injection amount to make a detection value of the air-fuel ratio sensor coincident with a previously given target air-fuel ratio and controls the fuel injection unit based on the calculated fuel injection amount;

a start-up completion judgment unit to judge whether the internal combustion engine is in a state where start-up has been completed;

an engine condition judgment unit to judge whether the internal combustion engine enters a normal condition after the start-up has been completed; and an upper/lower limit clipping unit that limit a maximum output of the calculation unit to an arbitrary first output range until the time when the engine condition judgment unit judges that the internal combustion engine enters the normal condition from the time when the start-up completion judgment unit judges that the start-up has been completed, and limits the changing range within a second output range larger than the first output range after the engine condition judgment unit judges that the internal combustion engine enters the normal condition.

11. The air-fuel ratio control apparatus for the internal combustion engine according to claim 10, wherein the first output range is within a range of 10% to 50% of the second output range.

12. The air-fuel ratio control apparatus for the internal combustion engine according to claim 10, further comprising an air-fuel ratio control state judgment unit to judge whether a difference between the air-fuel ratio detected by the air-fuel ratio sensor and the target air-fuel ratio is controlled within a previously determined deviation range, wherein the engine condition judgment unit judges that the internal combustion engine enters the normal condition when the air-fuel ratio control state judgment unit judges that the difference between the air-fuel ratio and the target air-fuel ratio is controlled within the specified deviation range.

13. The air-fuel ratio control apparatus for the internal combustion engine according to claim 12, wherein the air-fuel ratio control state judgment unit reads the detection value of the air-fuel ratio sensor repeatedly at specified time intervals, and when a state in which a deviation from the target air-fuel ratio is within a previously determined range is continuously detected a specified number of times, the air-fuel ratio control state judgment unit judges that the air-fuel ratio is controlled within the deviation range previously determined with respect to the target air-fuel ratio.

14. The air-fuel ratio control apparatus for the internal combustion engine according to claim 10, further comprising a timer that is activated when the start-up completion judgment unit judges that the start-up has been completed, wherein the engine condition judgment unit judges that the internal combustion engine enters the normal condition when the timer exceeds a previously determined time.

15. The air-fuel ratio control apparatus for the internal combustion engine according to claim 14, further comprising:

a water temperature sensor to measure water temperature of cooling water of the internal combustion engine; and a timer time adjustment unit to control the specified time of the timer based on the measured water temperature of the water temperature sensor.

16. The air-fuel ratio control apparatus for the internal combustion engine according to claim 10, further comprising an accelerator opening detection unit to detect an accelerator opening of the internal combustion engine, wherein the engine condition judgment unit judges that the internal combustion engine enters the normal condition when the accelerator opening exceeds a previously determined accelerator opening after the start-up completion judgment unit judges that the start-up has been completed.

* * * * *